US007410009B2

(12) United States Patent
Hirayama et al.

(10) Patent No.: US 7,410,009 B2
(45) Date of Patent: Aug. 12, 2008

(54) POWER TOOL

(75) Inventors: Toshiro Hirayama, Anjo (JP); Kenji Shibata, Anjo (JP); Takuo Arakawa, Anjo (JP); Yonosuke Aoki, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/444,375

(22) Filed: Jun. 1, 2006

(65) Prior Publication Data

US 2006/0272836 A1 Dec. 7, 2006

(30) Foreign Application Priority Data

Jun. 2, 2005 (JP) ..... 2005-162570
Jun. 2, 2005 (JP) ..... 2005-162606

(51) Int. Cl.
*B25F 5/00* (2006.01)

(52) U.S. Cl. ..... 173/201; 173/104; 173/213; 173/216; 184/6.14

(58) Field of Classification Search ..... 173/213, 173/216, 104, 201; 184/6.14, 64
See application file for complete search history.

(56) References Cited

U.S. PATENT DOCUMENTS 1,956,644 A * 5/1934 Hamerly ..... 184/55.1
3,162,268 A * 12/1964 Short ..... 184/5
3,774,700 A 11/1973 Shepherd
3,946,490 A * 3/1976 Sotman et al. ..... 433/82
4,183,414 A * 1/1980 Tamai et al. ..... 173/118
4,403,679 A * 9/1983 Snider ..... 184/64
5,293,959 A * 3/1994 Kimberlin ..... 184/6.14
5,638,935 A * 6/1997 Fehring ..... 192/105 B
6,109,366 A * 8/2000 Jansson et al. ..... 173/216
6,722,449 B2 * 4/2004 Lebisch et al. ..... 173/213
6,739,406 B2 5/2004 Lebisch et al.
7,032,683 B2 * 4/2006 Hetcher et al. ..... 173/1
7,036,607 B2 * 5/2006 Lebisch et al. ..... 173/109
2003/0121684 A1 7/2003 Lebisch et al.
2003/0190877 A1 10/2003 Gallagher et al.

FOREIGN PATENT DOCUMENTS

CN 1476959 A 2/2004
DE 8431462 9/1987
EP 0 589 337 A1 3/1994
JP A 2004-351595 12/2004

* cited by examiner

*Primary Examiner*—Scott A. Smith
(74) *Attorney, Agent, or Firm*—Oliff & Berridge, PLC

(57) ABSTRACT

It is an object of the present invention to provide an improved technique for preventing leakage of lubricant from an accommodating space that houses a driving mechanism, while regulating the internal pressure of the accommodating space in a power tool. A representative power tool includes a power tool body, a tool bit, a driving mechanism, a lubricant, an accommodating space, a passage and a lubricant leakage preventing region. The accommodating space is disposed in the body to house the driving mechanism and is hermetically sealed. The passage has an accommodating space side opening and an outside opening. The passage extends, starting from the accommodating space side opening, in a direction away from the outside opening. Then, the passage turns around and extends toward the outside opening. Further, the lubricant leakage preventing region is provided with the passage to prevent the lubricant from leaking from the inside to the outside of the accommodating space.

According to the invention, the length of the passage can be made longer and the lubricant must travel a longer distance before leaking out. Therefore, a higher effect of preventing leakage can be obtained.

6 Claims, 8 Drawing Sheets

POWER TOOL

BACKGROUND OF THE INVENTION

1. Field of the Invention

The present invention relates to a power tool, such as a hammer and a hammer drill, which is capable of regulating internal pressure of an accommodating space for a driving mechanism.

2. Description of the Related Art

Japanese non-examined laid-open Patent Publication No. 2004-508949 discloses an electric hammer drill capable of regulating the internal pressure of a gear housing. A driving mechanism to drive a tool bit is housed in the gear housing and is driven by a motor. The gear housing is filled with grease for lubricating the driving mechanism and is hermetically sealed so as to prevent leakage of the lubricant to the outside. In the known art, a spiral groove is formed in the outer surface of the rotating shaft mounted to the gear housing to function as a pressure regulating passage via which an inside and an outside of the gear housing communicate with each other. Further, a rotating member is provided on the rotating shaft. The rotating member allows the spiral groove to communicate with the inside of the gear housing when the rotating member rotates together with the rotating shaft, while it interrupts such communication when the rotating shaft is stopped. In this manner, the internal pressure is regulated so as not to excessively increase when the rotating shaft is rotated. As a result, a leakage of lubricant from the gear housing can be alleviated.

SUMMARY OF THE INVENTION

It is an object of the present invention to provide an improved technique for preventing leakage of lubricant from an accommodating space that houses a driving mechanism, while regulating the internal pressure of the accommodating space in a power tool.

This object is achieved by a representative power tool according to the present invention that includes a power tool body, a tool bit, a driving mechanism, a lubricant, an accommodating space, a passage and a lubricant leakage preventing region.

The tool bit is coupled to the power tool body and performs a predetermined operation to a workpiece. The driving mechanism drives the tool bit. The accommodating space is disposed in the body to house the driving mechanism and is hermetically sealed. The lubricant is filled within the accommodating space to lubricate the driving mechanism. Via the passage, an inside and an outside of the accommodating space communicate with each other. The passage has an accommodating space side opening that is open to the inside of the accommodating space and an outside opening that is open to the outside of the accommodating space. The passage extends, starting from the accommodating space side opening, in a direction away from the outside opening. Then, the passage turns around and extends toward the outside opening. Further, the lubricant leakage preventing region is provided with the passage to prevent the lubricant from leaking from the inside to the outside of the accommodating space.

The "power tool" according to the invention may typically include an impact tool such as a hammer and a hammer drill. The power tool may also includes a cutting power tool, a grinding and/or polishing power tool, or a fastening power tool for screw-tightening operation. The "outside of the accommodating space" includes not only the atmosphere outside the power tool body but also the other space located inside the power tool body.

According to the invention, when the inside of the accommodating space is heated by the driving mechanism during operation of the power tool, the inside air expands and thus the internal pressure of the accommodating space is raised. At this time, the air within the accommodating space is released to the outside of the accommodating space through the passage, so that the internal pressure of the accommodating space is regulated to be substantially constant. In addition to that, the passage extends, starting from the accommodating space side opening, in a direction away from the outside opening, then turns around and extends toward the outside opening and the lubricant leakage preventing region is provided in the passage. As a result, the length of the passage can be made longer and the lubricant must travel a longer distance before leaking out. Therefore, a higher effect of preventing leakage can be obtained.

As another aspect of the invention, representative power tool may include a pressure regulating chamber that is disposed outside the accommodating space within the power tool body to communicate with the accommodating space. The pressure regulating chamber increases the capacity in relation to an increase of an internal pressure of the accommodating space in order to prevent the internal pressure of the accommodating space from increasing and preventing the lubricant from leaking from the accommodating space. Other objects, features and advantages of the present invention will be readily understood after reading the following detailed description together with the accompanying drawings and the claims.

DETAILED DESCRIPTION OF THE REPRESENTATIVE EMBODIMENT

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment

Figure 1:
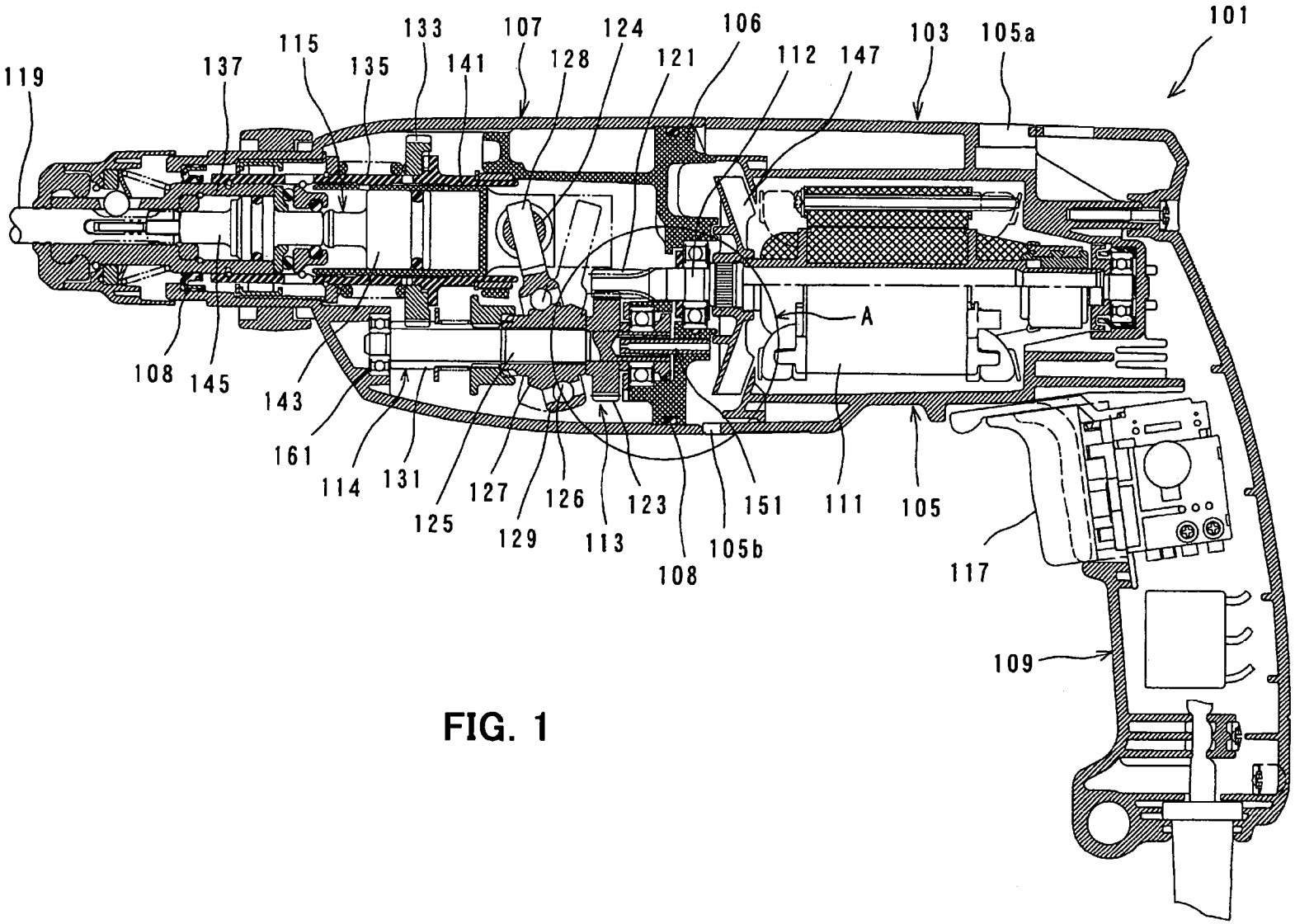
FIG. 1 is a sectional side view schematically showing an entire hammer drill according to a first embodiment of the invention.
Figure 2:
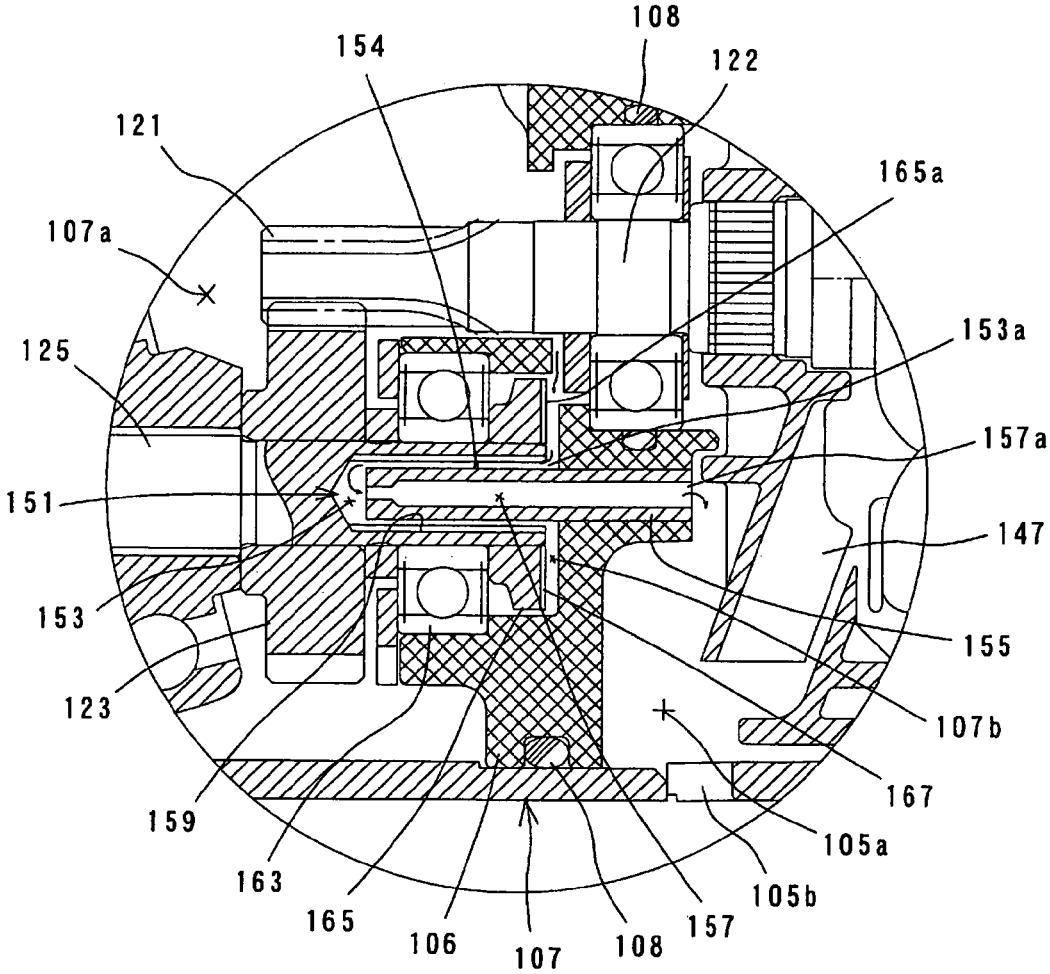
FIG. 2 is an enlarged view of circled part A in FIG. 1, showing the structure of a pressure regulating passage.
Figure 3:
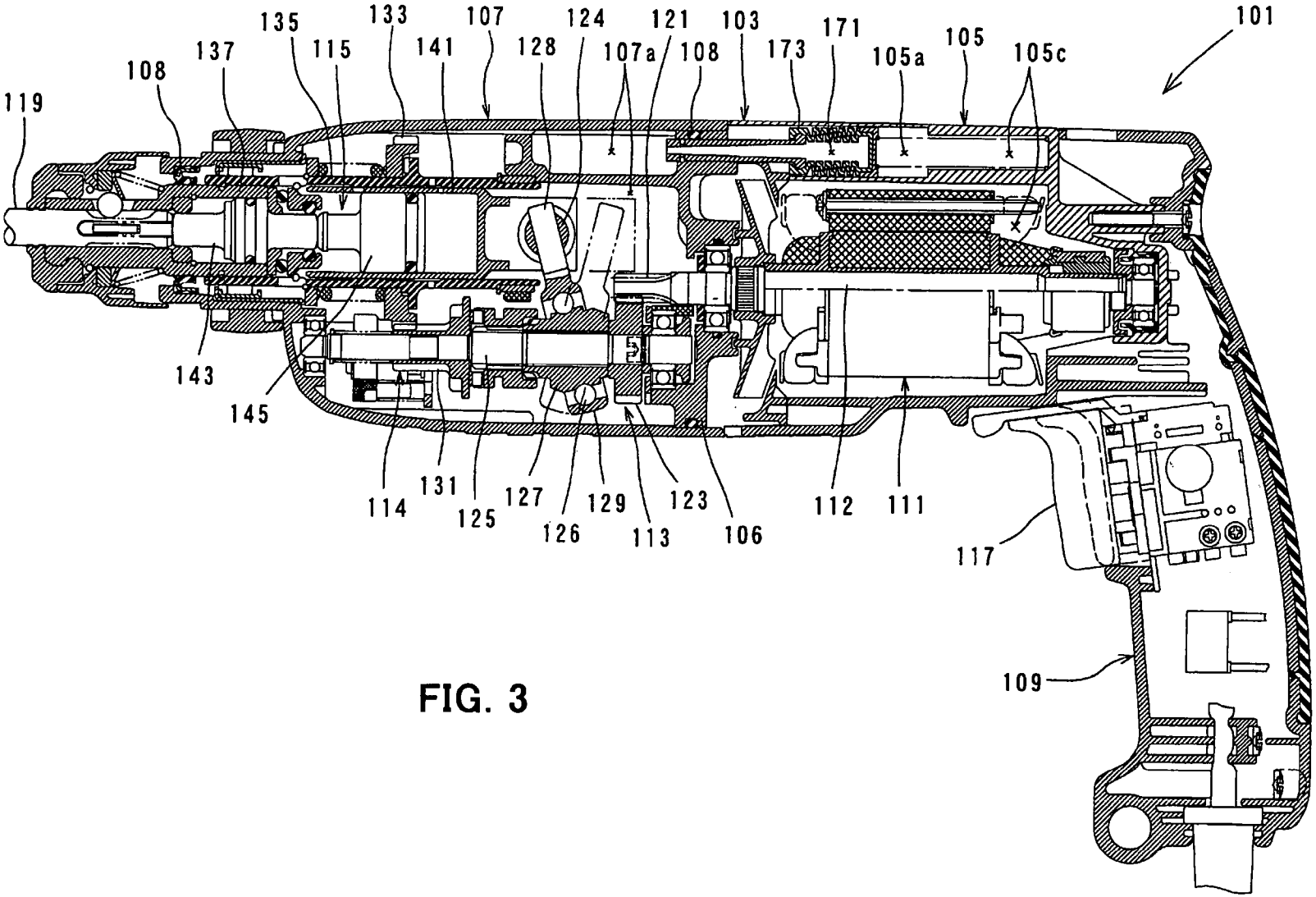
FIG. 3 is a sectional side view schematically showing an entire hammer drill according to a second embodiment of the invention.

A first embodiment of the present invention will now be described with reference to FIGS. 1 to 3. FIG. 1 is a sectional view showing an entire electric hammer drill 101 as a representative embodiment of the power tool according to the present invention. FIGS. 2 and 3 are enlarged sectional views showing part of the hammer drill 101. As shown in FIG. 1, the hammer drill 101 includes a body 103, a drill bit 119 detachably coupled to the tip end region (on the left side as viewed in FIG. 1) of the body 103 via a tool holder 137, and a grip 109 that is held by a user and connected to the rear end region (on the right side as viewed in FIG. 1) of the body 103. The drill bit 119 is mounted such that it is allowed to reciprocate with respect to the tool holder 137 in its axial direction and rotate together with the tool holder 137 in its circumferential direction. The drill bit 119 is a feature that corresponds to the "tool bit" according to the present invention. In the present embodiment, for the sake of convenience of explanation, the side of the drill bit 119 is taken as the front side and the side of the grip 109 as the rear side.

The body 103 includes a motor housing 105 that houses a driving motor 111, and a gear housing 107 that houses a motion converting mechanism 113, a power transmitting mechanism 114 and a striking mechanism 115. The motor housing 105 and the gear housing 107 are connected to each other by screws or other similar means (not shown). The motion converting mechanism 113, the power transmitting mechanism 114 and the striking mechanism 115 are features that correspond to the "driving mechanism" according to the invention. An inner housing 106 is disposed within the gear housing 107 on the side adjacent to the joint with the motor housing 105 and separates an inner space 107*a* of the gear housing 107 and an inner space 105*a* of the motor housing 105. The gear housing 107 and the inner housing 106 are hermetically sealed appropriately by a sealing member 108 at a predetermined point of joint. The inner space 107*a* of the gear housing 107 is filled with lubricant (grease) for lubricating sliding parts of the motion converting mechanism 113 and the power transmitting mechanism 114. The inner space 107*a* of the gear housing 107 is a feature that corresponds to the "accommodating space" according to the invention.

The motion converting mechanism 113 appropriately converts the rotating output of the driving motor 111 to linear motion and then to transmit it to the striking mechanism 115. As a result, an impact force is generated in the axial direction of the drill bit 119 via the striking mechanism 115. Further, the power transmitting mechanism 114 appropriately reduces the speed of the rotating output of the driving motor 111 and transmits the rotating output as rotation to the drill bit 119. Thus, the drill bit 119 is caused to rotate in the circumferential direction. Here, the driving motor 111 is driven by depressing a trigger 117 that is mounted on a handgrip 109.

As shown in FIGS. 2 and 3, the motion converting mechanism 113 includes a driving gear 121 that is mounted on the end (front end) of an armature shaft 112 of the driving motor 111 and is caused to rotate in a vertical plane, a driven gear 123 that engages with the driving gear 121, a rotating element 127 that rotates together with the driven gear 123 via a rotating shaft 125, a swinging ring 129 that is caused to swing in the axial direction of the drill bit 119 by rotation of the rotating element 127, and a cylinder 141 that is caused to reciprocate by swinging movement of the swinging ring 129. The rotating shaft 125 is disposed parallel (horizontally) to the axial direction of the drill bit 119. The outer surface of the rotating element 127 that is fitted onto the rotating shaft 125 is inclined at a predetermined angle with respect to the axis of the rotating shaft 125. The swinging ring 129 is fitted on the inclined outer surface of the rotating element 127 via a ball bearing 126 such that it can rotate with respect to the rotating element 127. The swinging ring 129 is caused to swing in the axial direction of the drill bit 119 by rotation of the rotating element 127. Further, the swinging ring 129 has a swinging rod 128 extending upward (in the radial direction) from the swinging ring 129. The swinging rod 128 is loosely fitted in an engaging member 124 that is formed in the rear end portion of the cylinder 141. The rotating element 127, the swinging ring 129 and the cylinder 141 forms a swinging mechanism.

As shown in FIG. 1, the power transmitting mechanism 114 includes a first transmission gear 131 that is caused to rotate in a vertical plane by the driving motor 111 via the driving gear 121 and the rotating shaft 125, a second transmission gear 133 that engages with the first transmission gear 131, a sleeve 135 that is caused to rotate together with the second transmission gear 133, and a tool holder 137 that is caused to rotate together with the sleeve 135 in a vertical plane.

As shown in FIG. 1, the striking mechanism 115 includes a striker 143 that is slidably disposed within the bore of the cylinder 141, and an impact bolt 145 that is slidably disposed within the tool holder 137 and is adapted to transmit the kinetic energy of the striker 143 to the drill bit 119.

In the hammer drill 101 thus constructed, when the driving motor 111 is driven, the driving gear 121 is caused to rotate in a vertical plane by the rotating output of the driving motor 111. Then, the rotating element 127 is caused to rotate in a vertical plane via the driven gear 123 that engages with the driving gear 121, and the rotating shaft 125. Thus, the swinging ring 129 and the swinging rod 128 are then caused to swing in the axial direction of the drill bit 119, which in turn causes the cylinder 141 to slide linearly. The sliding movement of the cylinder 141 causes the action of an air spring within the cylinder 141, which causes the striker 143 to linearly move within the cylinder 141. The striker 143 collides with the impact bolt 145 and transmits the kinetic energy to the drill bit 119.

When the first transmission gear 131 rotates together with the rotating shaft 125, the sleeve 135 is caused to rotate in a vertical plane via the second transmission gear 133 that engages with the first transmission gear 131. Further, the tool holder 137 and the drill bit 119 that is supported by the tool holder 137 rotate together with the sleeve 135. Thus, the drill bit 119 performs a drilling operation on a workpiece (concrete) by a hammering movement in the axial direction and a drilling movement in the circumferential direction.

During the drilling operation by the hammer drill 101, the inner space 107*a* of the gear housing 107 is heated by the driving movement of the motion converting mechanism 113, the power transmitting mechanism 114 and the striking mechanism 115. As a result, air within the hermetic gear housing 107 expands and thus the internal pressure of the gear housing 107 is raised. At this time, the pressure of the space between the striker 143 and the impact bolt 145 which communicates with the inner space 107*a* of the gear housing 107 is also raised. As a result, when the striker 143 is caused to reciprocate via the action of the air spring within the cylinder 141 by the sliding movement of the cylinder 141, the pressure balance between the air spring chamber of the cylinder 141 and the space between the striker 143 and the impact bolt 145 may be lost, so that the striker 143 may not be able to properly reciprocate or may cause a striking failure. Further, when the internal pressure of the gear housing 107 is raised, the lubricant within the gear housing 107 may leak to the outside through the sealing surface sealed by the sealing member 108. In order to prevent such deficiencies, a pressure regulating passage 151 is provided in the gear housing 107 and regulates the internal pressure of the gear housing 107 by leading air from the gear housing 107 to the outside when the internal pressure of the gear housing 107 is raised. The pressure regulating passage 151 is a feature that corresponds to the "passage" according to this invention.

FIG. 2 is an enlarged view of circled part A in FIG. 1, showing the structure of the pressure regulating passage 151 that regulates the internal pressure of the gear housing 107. The pressure regulating passage 151 is provided such that the inner space 107*a* of the gear housing 107 and the inner space 105*a* of the motor housing 105 communicate with each other via the pressure regulating passage 151. The motor housing 105 has a vent 105*b* via which the inner space 105*a* of the motor housing 105 communicates with the outside (atmosphere) such that the driving motor 111 is cooled. Therefore, the pressure within the gear housing 107 is maintained about the same as the atmospheric pressure. A cooling fan 147 is mounted to the armature shaft 112 and serves to cool the driving motor 111 by rotating together with the armature shaft 112. The inner space 105*a* of the motor housing 105 is a feature that corresponds to the "outside" according to this invention.

The pressure regulating passage 151 is provided in the rotating shaft region that forms the motion converting mechanism 113. Specifically, the pressure regulating passage 151 is formed in the rotating shaft 125 and a cylindrical member 155. A closed-end stop hole 153 is formed in one axial end (rear end) of the rotating shaft 125 and axially extends a predetermined length. A through hole 157 axially extends through the cylindrical member 155.

The cylindrical member 155 is fixedly inserted through the inner housing 106 of the gear housing 107 from the outside such that it protrudes a predetermined length into the inner space 107*a* of the gear housing 107. One end (the rear end) of the through hole 157 of the cylindrical member 155 is open to the inner space 105*a* of the motor housing 105 and defines an outlet 157*a* of the pressure regulating passage 151. The outlet 157*a* is a feature that corresponds to the "outside opening" according to the invention. The rotating shaft 125 is rotatably supported by bearings 161, 163 on the both axial ends. The rotating shaft 125 and the cylindrical member 155 are fitted together such that they can rotate with respect to each other and in such a manner that the stop hole 153 of the rotating shaft 125 entirely receives the cylindrical member 155. The other end (front end) of the through hole 157 of the cylindrical member 155 is open to the stop hole 153 of the rotating shaft 125 near the bottom of the stop hole 153. A clearance 154 which is needed to allow rotation of the rotating shaft 125 is provided between the inner surface of the stop hole 153 and the outer surface of the cylindrical member 155. Further, the stop hole 153 is open to the inner space 107*a* of the gear housing 107 at the wall of the inner housing 106 and defines an inlet 153*a* of the pressure regulating passage 151. The inlet 153*a* is a feature that corresponds to the "accommodating space side opening" according to the invention.

Thus, the clearance 154 between the inner surface of the rotating shaft 125 and the outer surface of the cylindrical member 155 and the through hole 157 of the cylindrical member 155 define the pressure regulating passage 151. The pressure regulating passage 151 starts from the inlet 153*a* that is open to the inner space 107*a* of the gear housing 107, and then extends in a direction away from the outlet 157*a* that is open to the inner space 105*a* of the motor housing 105. Thereafter, the pressure regulating passage 151 turns around in the midway and extends toward the outlet 157*a*. The end region of the rotating shaft 125 is a feature that corresponds to the "outside member" and the "outer tubular member", while the cylindrical member 155 is a feature that correspond to the "inside member" and the "inner tubular member" according to the invention.

Further, in the region of the pressure regulating passage 151 which extends from the inlet 153*a* in a direction away from the outlet 157*a*, a spiral groove 159 is formed on the entire axial length of the inner surface of the stop hole 153. The spiral groove 159 serves to prevent leakage of lubricant from the gear housing 107 to the motor housing 105 through the pressure regulating passage 151. The spiral groove 159 is configured such that its spiral direction is opposite to the direction of rotation of the rotating shaft 125 when viewed from the inlet side of the stop hole 153 (rear side of the hammer drill 101). For example, when the rotating shaft 125 is configured to rotate clockwise, the spiral direction of the spiral groove 159 is counterclockwise. Specifically, the spiral groove 159 acts upon the lubricant which is leaking through the stop hole 153 during rotation of the rotating shaft 125, in such a manner as to push (deliver) the lubricant back toward the inlet 153*a*. The spiral groove 159 may have an appropriately selected sectional shape, such as a V-shape, U-shape and a rectangular shape.

The driven gear 123, the bearing 163 and a stopper ring 165 are fitted onto the rear end portion of the rotating shaft 125 from front to rear in this order. The bearing 163 and the stopper ring 165 are accommodated within a circular accommodation recess 107*b* formed in the inner housing 106. The stopper ring 165 is press-fitted onto the rear end of the rotating shaft 125. As a result, the bearing 163 and the driven gear 123 are axially positioned on the rotating shaft 125. An axial end surface 165*a* of the stopper ring 165 faces with the inner wall surface of the accommodation recess 107*b* of the inner housing 106 with a slight clearance therebetween. A spiral groove 167 is formed on the axial end surface 165*a* of the stopper ring 165. The spiral groove 167 serves to send the lubricant which has entered the groove 167 flying radially outward by centrifugal force to thereby prevent the lubricant from entering the inlet 153*a* of the stop hole 153. The spiral groove 167 may have an appropriately selected sectional shape, such as a V-shape, U-shape and a rectangular shape.

As mentioned above, the pressure regulating passage 151 is provided in the gear housing 107 such that the inner space 107*a* of the gear housing 107 communicates with the inner space 105*a* of the motor housing 105 which is in communication with the atmosphere. Therefore, during the drilling operation by the hammer drill 101, the inner space 107*a* of the gear housing 107 is heated by the driving movement of the motion converting mechanism 113, the power transmitting mechanism 114 and the striking mechanism 115. As a result, air within the hermetic gear housing 107 expands and thus the internal pressure of the gear housing 107 is raised. At this time, air within the gear housing 107 flows out into the inner space 105*a* of the motor housing 105 via the pressure regulating passage 151. Specifically, the pressure within the gear housing 107 is released. Thus, the internal pressure of the gear housing 107 is regulated so as to be prevented from being raised. As a result, a striking failure which may be caused by increase of the internal pressure of the gear housing 107 can be prevented. Flow of air for the pressure regulation is shown by arrow in FIG. 2.

The pressure regulating passage 151 extends, starting from the inlet 153*a* on the open end of the stop hole 153, in a direction away from the outlet 157*a* through the clearance 154, then turns around at the bottom of the stop hole 153 and extends to the outlet 157*a* through the through hole 157 of the cylindrical member 155. With this construction, the length of the pressure regulating passage 151 can be made longer. Lubricant which has entered the inlet 153*a* cannot leak out from the outlet 157*a* unless it is led through the pressure regulating passage 151 in a direction away from the outlet 157*a*. Thus, the lubricant must travel a longer distance before leaking out. Therefore, a higher effect of preventing lubricant leakage can be obtained. Further, the spiral groove 159 is formed in the inner surface of the stop hole 153 and extends in a spiral direction in which the spiral groove advances from the hole bottom side toward the inlet 153*a* when the rotating shaft 125 rotates. Therefore, lubricant deposited on the inner surface of the stop hole 153 is pushed back toward the inlet 153*a* by the spiral groove 159. Thus, the leakage of lubricant into the motor housing 105 (outside) can be prevented.

Further, the rotating shaft 125 having the stop hole 153 and the cylindrical member 155 having the through hole 157 are fitted together to form the pressure regulating passage 151. Therefore, the pressure regulating passage 151 can be formed with a smaller number of parts, so that the structure can be simpler and the costs can be reduced.

Further, the inlet 153*a* is formed at the wall of the inner housing 106. Typically, the motion converting mechanism 113 and the power transmitting mechanism 114 which are housed within the gear housing 107 are placed apart from the wall surface of the gear housing 107. Accordingly, lubricant is provided around the rotating parts of the motion converting mechanism 113 and the power transmitting mechanism 114. Therefore, the effect of preventing the entry of lubricant into the inlet 153*a* can be enhanced by providing the inlet 153*a* at the wall of the inner housing 106. Moreover, the spiral groove 167 is formed on the axial end surface 165*a* of the stopper ring 165 that rotates together with the rotating shaft 125. Therefore, lubricant deposited on the spiral groove 167 can be sent flying radially outward by centrifugal force, so that the entry of lubricant into the inlet 153*a* can be prevented.

The invention can be applied to a hammer drill of the type which utilizes a crank mechanism as the motion converting mechanism 113. Further, the invention is not limited to the hammer drill 101 but may be applied to any power tool in which a housing for a driving mechanism is filled with lubricant for lubricating the driving mechanism.

Second Embodiment

Figure 4:
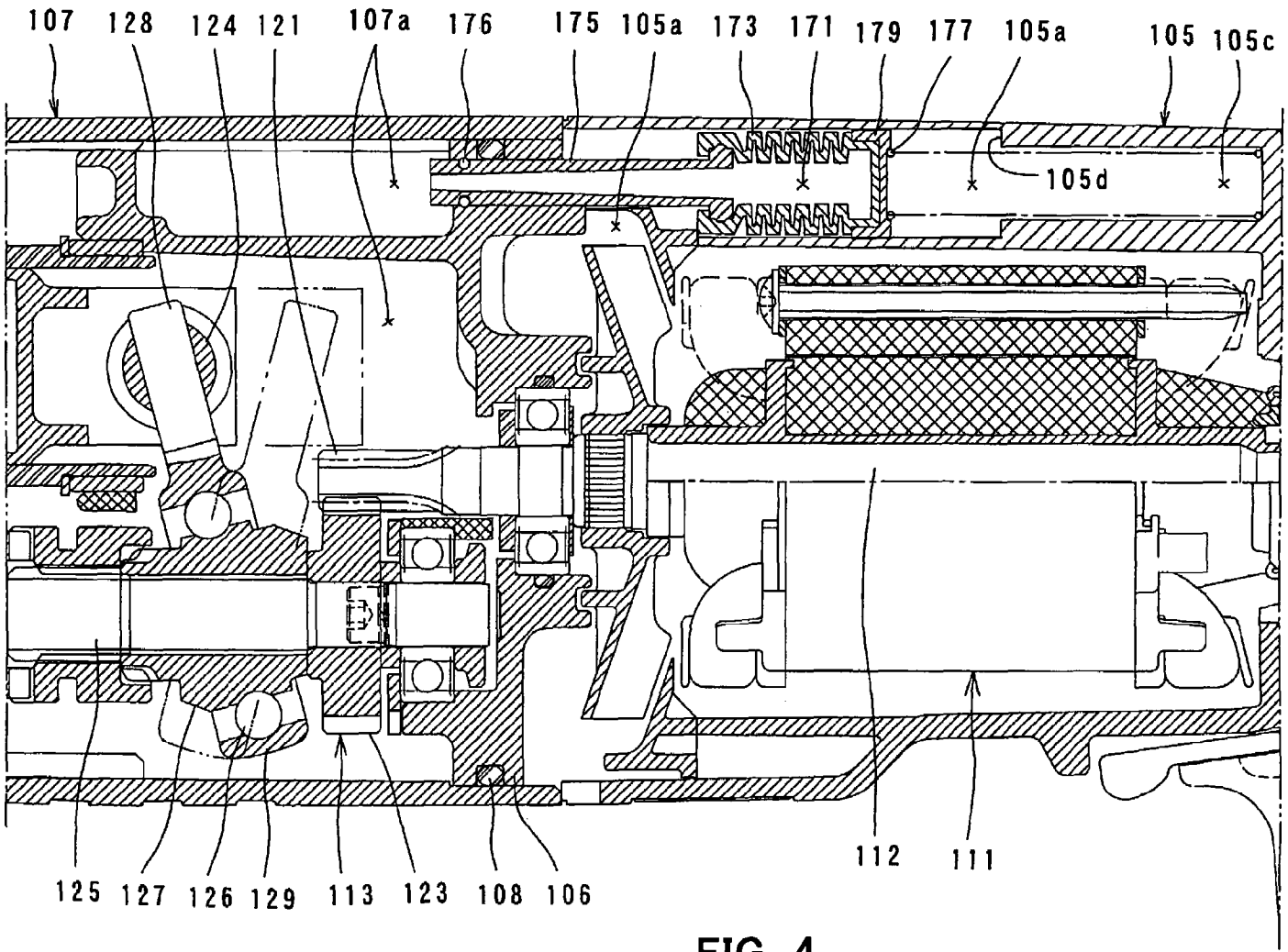
FIG. 4 is an enlarged sectional view of part of a driving mechanism of the hammer drill, showing the state in which the capacity of a pressure regulating chamber is reduced.
Figure 5:
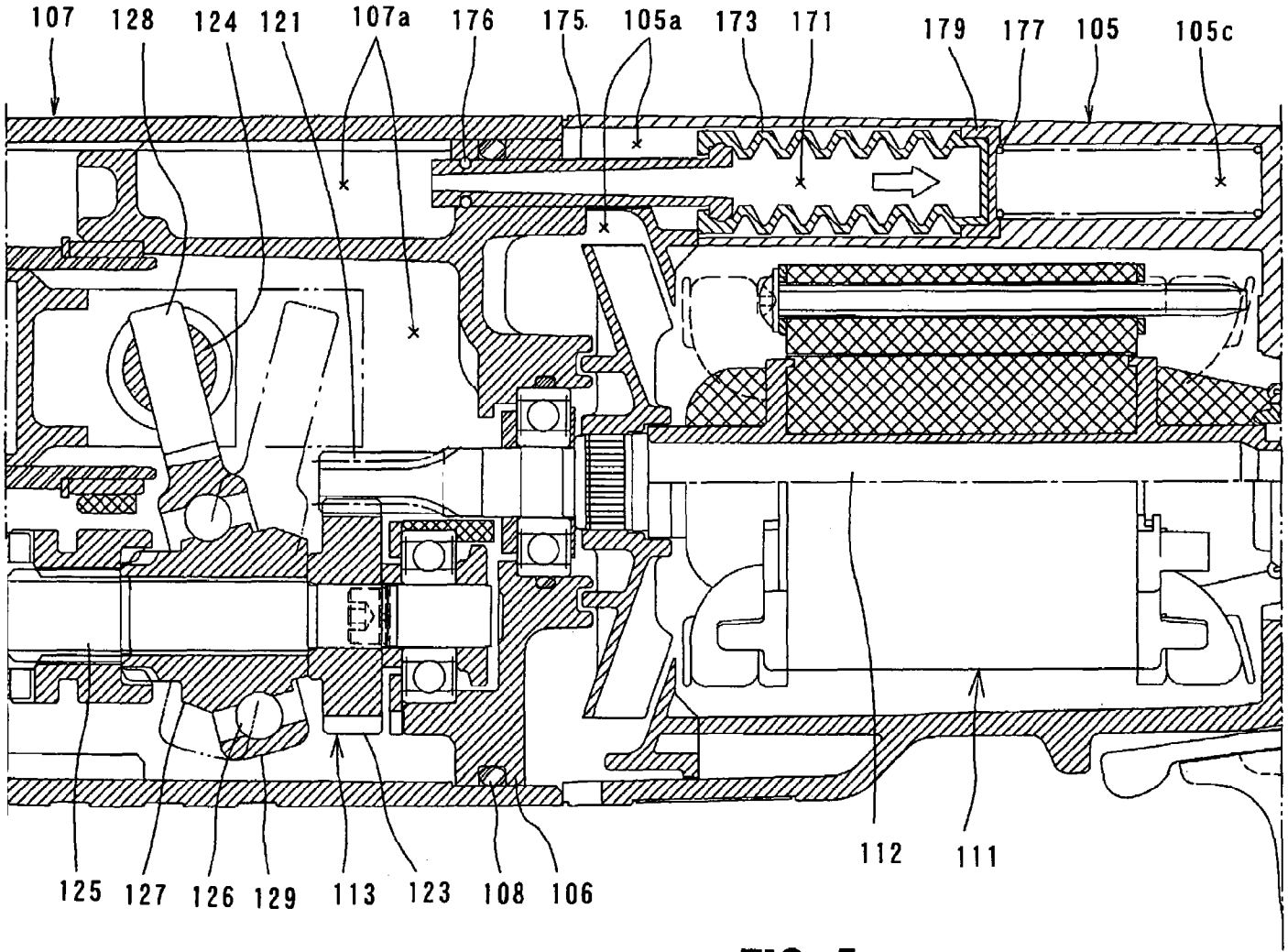
FIG. 5 is an enlarged sectional view of part of the driving mechanism of the hammer drill, showing the state in which the capacity of the pressure regulating chamber is increased.

A second embodiment of the present invention will now be described with reference to FIGS. 3 to 5. Features having same construction with the above-described first representative embodiment are described with the same reference number with the one of the first embodiment. FIG. 3 is a sectional view showing an entire electric hammer drill 101 as a representative embodiment of the power tool according to the present invention. FIGS. 4 and 5 are enlarged sectional views showing part of the hammer drill 101.

According to the second representative embodiment, a pressure regulating chamber 171 is provided within the inner space 105*a* of the motor housing 105 and regulates the internal pressure of the gear housing 107 by varying its capacity as the internal pressure of the gear housing 107 increases.

FIGS. 4 and 5 show the pressure regulating chamber 171 in enlarged view. FIG. 4 shows the state in which the capacity of the pressure regulating chamber 171 is reduced, while FIG. 5 shows the state in which the capacity of the pressure regulating chamber 171 is increased. The pressure regulating chamber 171 is defined by a space which is surrounded by an extensible bellows-like hollow member 173 made of elastic material such as rubber or resin. The hollow member 173 is a feature that corresponds to the "pressure regulating chamber wall" according to the invention. The hollow member 173 is disposed within the inner space 105*a* of the motor housing 105 such that its direction of movement for varying the capacity or its extending direction coincides with the axial direction of the driving motor 111 or the longitudinal direction of the body 103. The bore or the inner space of the hollow member 173 forming the pressure regulating chamber 171 is open only at one axial end (the front end). A mounting pipe 175 having a smaller diameter than the hollow member 173 is connected to the hollow member 173 with its one axial end tightly fitted into the open end of the bore of the hollow member 173. The other axial end (front end) of the mounting pipe 175 is inserted into the inner space 107*a* of the gear housing 107 through a mounting hole 106*a* of the inner housing 106. Specifically, the pressure regulating chamber 171 communicates with the inner space 107*a* of the gear housing 107 via the mounting pipe 175. A seal 176 is provided on the fitting surface between the mounting pipe 175 and the mounting hole 106*a*.

The capacity of the pressure regulating chamber 171 changes when the hollow member 173 extends and contracts by elastic deformation. Specifically, when the internal pressure of the inner space 107*a* of the gear housing 107 is not raised, as shown in FIG. 4, the hollow member 171 is kept in a contracted state and the capacity of the pressure regulating chamber 171 is held reduced. On the other hand, when the internal pressure of the inner space 107*a* of the gear housing 107 is raised, the bellows portion of the hollow member 173 extends by elastic deformation, resulting in increase in the capacity of the pressure regulating chamber 171.

Further, a compression coil spring 177 is disposed on the rear side of the hollow member 173 and biases the hollow member 173 in a contracting direction that reduces the capacity of the pressure regulating chamber 171. The compression coil spring 177 is a feature that corresponds to the "biasing member" according to this invention. The compression coil spring 177 is elastically disposed between a cap 179 that is fitted on the axial other end of the hollow member 173 and the wall surface of the motor housing 105. Thus, when the hollow member 173 extends in a direction to increase the capacity of the pressure regulating chamber 171, the compression coil spring 177 acts upon the hollow member 173 in such a manner as to control the extension of the bellows portion of the hollow member 173 so as to prevent excessive extension of the bellows portion. Further, the compression coil spring 177 acts upon the hollow member 173 in such a manner as to assist the extended hollow member 173 in returning to a contracted state or the initial position. The compression coil spring 177 is disposed within a circular recess 105*c* of the motor housing 105 so that the extending and contracting movement is stabilized. Further, a wall surface 105*d* (see FIG. 2) is formed in the motor housing 105 on the side of the open end of the recess 105*c* such that the cap 179 can abut on the wall surface 105*d* when the hollow member 173 extends. Thus, the wall surface 105*d* serves as a stopper to limit the maximum extension of the hollow member 173. Thus, excessive extension of the hollow member 173 can be avoided.

As mentioned above, the pressure regulating chamber 171 changes in capacity by extension and contraction of the hollow member 173 and communicates with the inner space 107*a* of the gear housing 107. Specifically, the same pressure acts upon the inside of the pressure regulating chamber 171 as the inner space 107*a* of the gear housing 107. Therefore, during the drilling operation by the hammer drill 101, the inner space 107*a* of the gear housing 107 is heated by the driving movement of the motion converting mechanism 113, the power transmitting mechanism 114 and the striking mechanism 115. As a result, air within the hermetic gear housing 107 expands and thus the internal pressure of the gear housing 107 is raised. At this time, the pressure of the inside of the pressure regulating chamber 171 is also raised, and accordingly the hollow member 173 extends against the compression coil spring 177. Therefore, the capacity of the pressure regulating chamber 171 increases (see FIG. 3), and thus the capacity of the inner space 107*a* of the gear housing 107, including the capacity of the pressure regulating chamber 171, increases. As a result, the increase of the internal pressure of the gear housing 107 can be prevented. Thus, a striking failure which may be caused by increase of the internal pressure of the gear housing 107 can be prevented, and leakage of the lubricant can also be prevented.

When the inner space 107*a* of the gear housing 107 is cooled and its internal pressure drops, the hollow member 173 is acted upon by a suction force which is caused by a negative pressure formed in the inner space 107*a* of the gear housing 107 by such cooling. As a result, the hollow member 173 contracts and returns to the initial position. At this time, the elastic restoring force of the bellows portion and the biasing force of the compression coil spring 177 act upon the hollow member 173 in such a manner as to assist the contraction of the hollow member 173. Specifically, the elastic force of the bellows portion of the hollow member 173 and the spring force of the compression coil spring 177 serve to assist the contraction of the hollow member 173 and are set so as to reliably restore the hollow member 173 to the initial position while maintaining the effect of preventing the pressure rise within the inner space 107*a* of the gear housing 107 or controlling the pressure to within a range in which a striking failure is not caused.

The pressure regulating chamber 171 communicates only with the inner space 107*a* of the gear housing 107. Therefore, the pressure regulating chamber 171 can be placed apart from the inner space 107*a* of the gear housing 107 of which pressure is to be regulated, or by utilizing the inner space 105*a* of the motor housing 105 outside the gear housing 107. As a result, compared with the case in which the pressure regulating chamber 171 is disposed within the gear housing 107, such construction can ensure a wider space inside the gear housing 107 and is thus effective in preventing rise of the internal pressure. The hollow member 173 is disposed within the motor housing 105 such that its extending direction substantially coincides with the axial direction of the driving motor 111 (the longitudinal direction of the body 103). With such construction, the installation space of the hollow member 173 can be easily ensured without change or with slight change, if any, in the radial dimension of the preexisting motor housing 105. Further, with the construction in which the hollow member 173 does not move in a direction crossing the longitudinal direction of the body 103, even though the motor housing 105 houses the hollow member 173 inside, it does not considerably bulge radially outward and can have a good appearance. Further, effective use can be made of a preexisting dead space within the inner space 105*a* of the motor housing 105 for installation of the hollow member 173.

Further, the hollow member 173 is configured to change its capacity by the elastic deformation of the bellows portion so that the direction of movement can be steady. Further, the hollow member 173 is normally biased by the compression coil spring 177 in the contracting direction that reduces the capacity of the pressure regulating chamber 171. Thus, the maximum extension of the bellows portion of the hollow member 173 can be limited to a certain point by the compression coil spring 177. If, for example, the hollow member 173 is held under pressure with the bellows portion excessively extended, the bellows portion may be rendered unable to be restored to its original state in a relatively short time. In this connection, the compression coil spring 177 can limit the extension of the bellows portion so that the elastic restoring force of the bellows portion can be maintained and the durability can be enhanced. Further, even if the elastic restoring force of the bellows portion is weakened, the hollow member 173 can be reliably restored to its initial position by the compression coil spring 177.

The pressure regulating chamber 171 may be defined by a plurality of hollow members that are slidably connected to each other and adapted to change its capacity by relative sliding movement of the hollow members in the axial direction. Specifically, the pressure regulating chamber 171 may have a telescopic structure. With the telescopic structure which does not utilize elastic deformation, it is made possible to provide the pressure regulating chamber 171 which is more resistant to trouble and thus has higher durability. Alternatively, the pressure regulating chamber 171 may be defined, for example, by an element, such as a balloon (bag), which moves in all directions to change its capacity.

Third Embodiment

Figure 6:
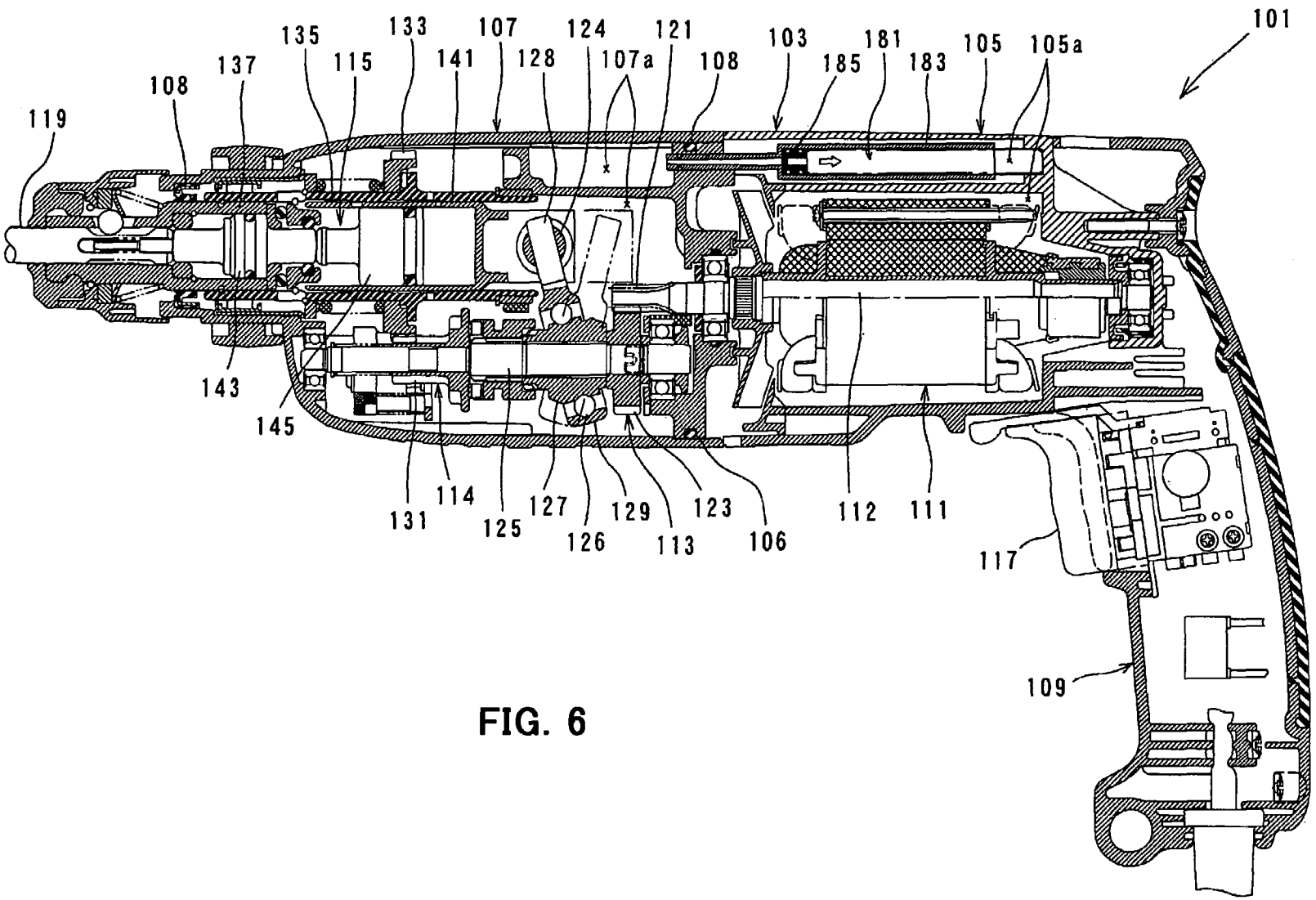
FIG. 6 is a sectional side view schematically showing an entire hammer drill according to a third embodiment of the invention.
Figure 7:
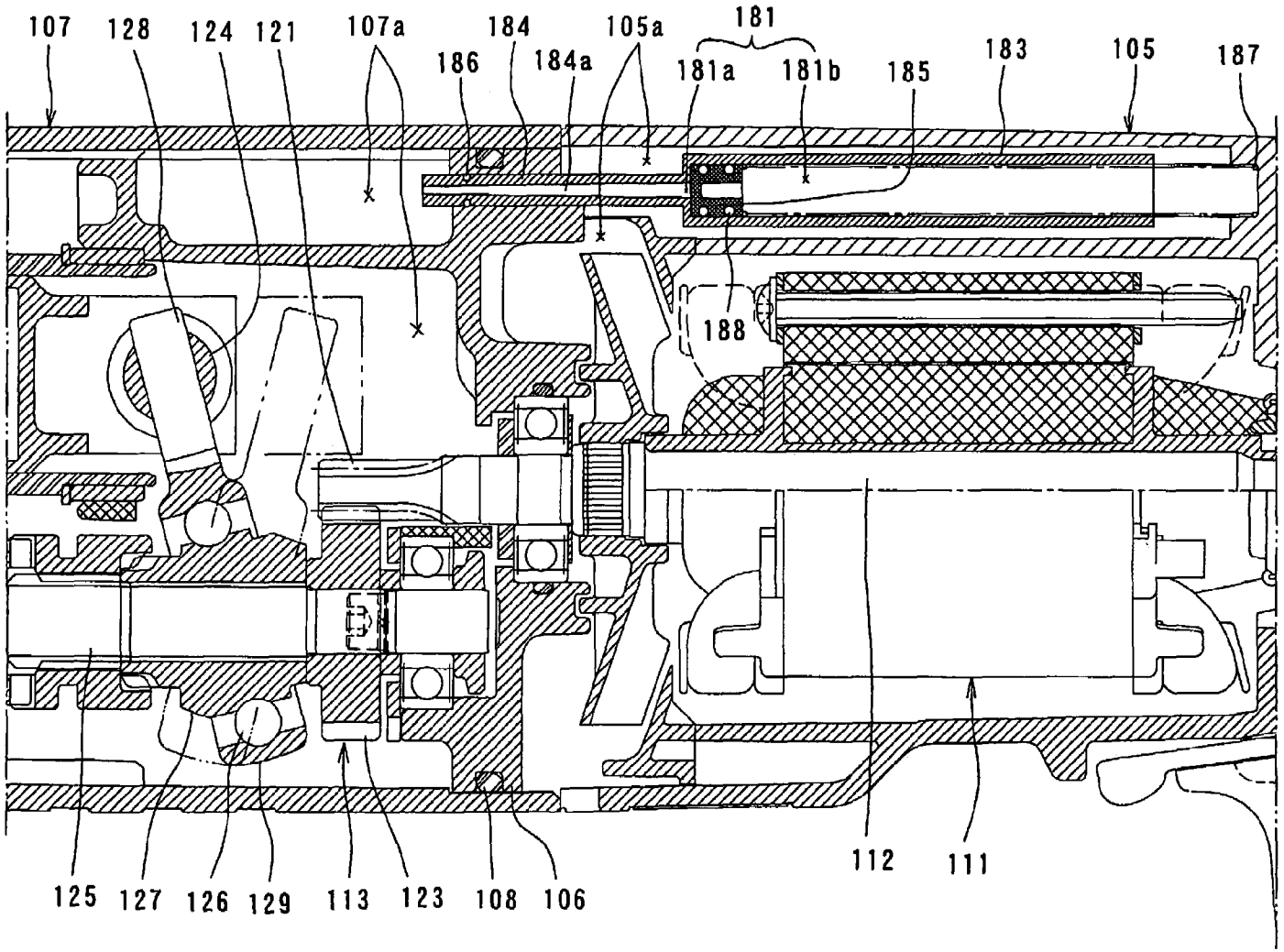
FIG. 7 is an enlarged sectional view of part of a driving mechanism of the hammer drill, showing the state in which the capacity of a gear housing side region of a pressure regulating chamber is reduced.
Figure 8:
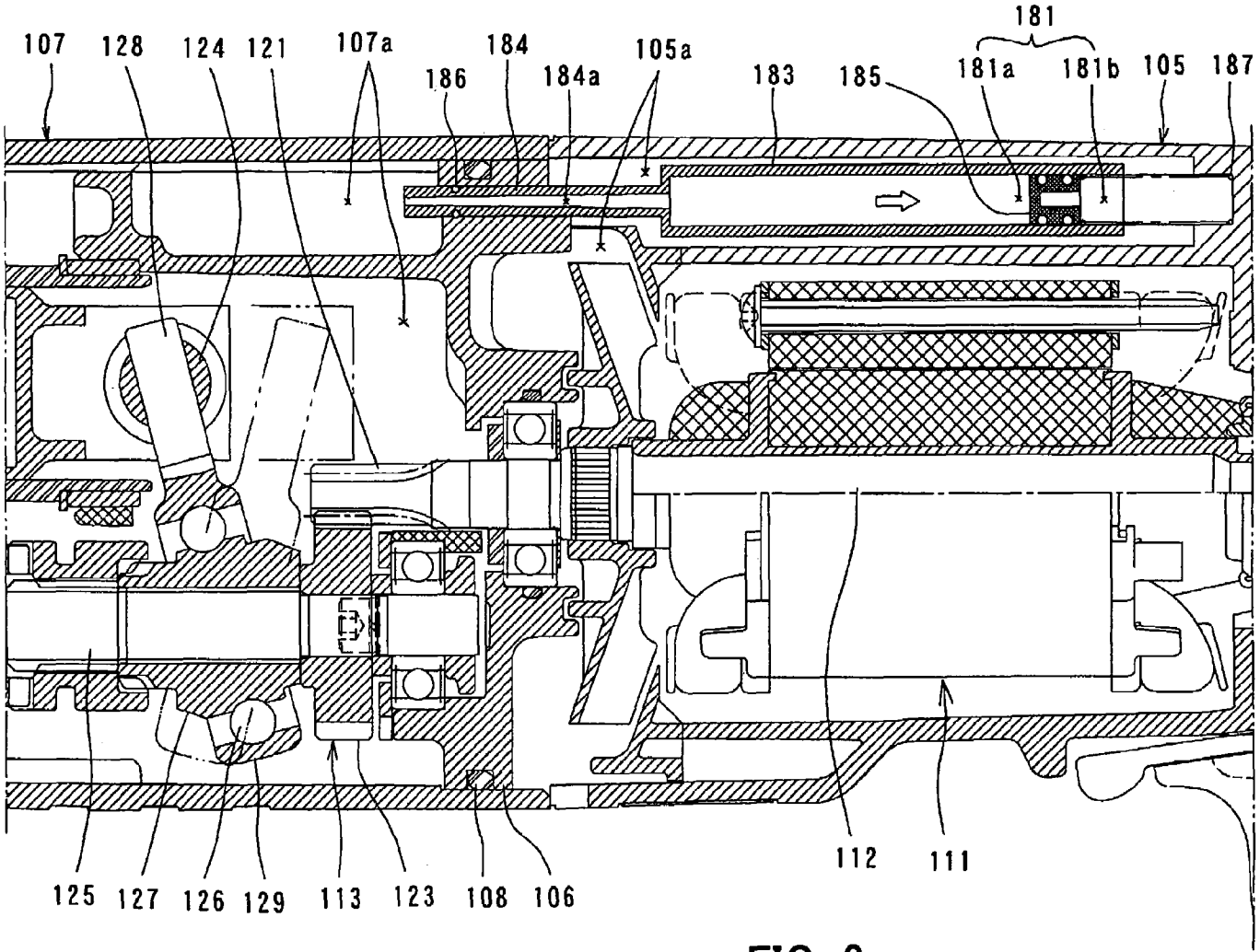
FIG. 8 is an enlarged sectional view of part of the driving mechanism of the hammer drill, showing the state in which the capacity of the gear housing side region of the pressure regulating chamber is increased.

Now, a third embodiment of the present invention will be described with reference to FIGS. 6 to 8. In this embodiment, a pressure regulating chamber 181 is defined by a bore of a cylindrical member in the form of a cylinder 183. A piston 185 is slidably disposed as a sliding element within the bore of the cylinder 183. In the other points, the hammer drill 101 of this embodiment has the same construction as the first and second embodiments. The other components or elements in the second embodiment which are substantially identical to those in the first and second embodiment are given like numerals as in the first embodiment and will not be described. The piston 185 is a feature that corresponds to the "movable element" according to the invention.

The pressure regulating chamber 181 defined by the bore of the cylinder 183 is divided into two regions 181*a*, 181*b* by the piston 185. One region 181*a* (on the left side as viewed in the drawings) communicates with the inner space 107*a* of the gear housing 107 via a through hole 184*a* of a small-diameter cylindrical portion 184 that extends from the axial end of the cylinder 183. The other region 181*b* (on the right side as viewed in the drawings) communicates with the inner space 105*a* of the motor housing 105. Thus, pressure on the side of the inner space 107*a* of the gear housing 107 and pressure on the side of the inner space 105*a* of the motor housing 105 act upon the associated axial end surfaces of the piston 185 from opposite sides of the piston 185. The piston 185 is caused to slide by the difference of the pressures acting upon the piston 185 from opposite sides. Specifically, when the internal pressure of the gear housing 107 is raised, the piston 185 moves rightward (as viewed in the drawings), resulting in increase of the capacity of the one region 181*a* that is in communication with the inner space 107*a* of the gear housing 107 (see FIG. 6). A seal 188 is disposed between the outer surface of the piston 185 and the inner, surface of the cylinder 183 and renders the two regions 181*a*, 181*b* airtight with respect to each other. The one region 181*a* and the other region 181*b* will be hereinafter referred to as the gear housing side region 181*a* and the motor housing side region 181*b*, respectively.

The cylinder 183 is disposed within the inner space 105*a* of the motor housing 105 such that its axial direction or the sliding direction of the piston 185 coincides with the longitudinal direction of the body 103. A compression coil spring 187 is disposed in the motor housing region 181*b* that is in communication with the inner space 105*a* of the motor housing 105. The compression coil spring 187 biases the piston 185 toward the gear housing side region 181*a* or in a direction that reduces the capacity of the gear housing side region 181*a*. Therefore, the piston 185 is normally held in its initial position (see FIGS. 6 and 7). The cylinder 183 is fixedly mounted to the inner housing 106 with the small-diameter cylindrical portion 184 inserted through the mounting hole 106*a* of the inner housing 106. Further, a seal 186 is provided on the fitting surface between the small-diameter cylindrical portion 184 and the mounting hole 106*a*.

During the drilling operation by the hammer drill 101, the inner space 107*a* of the gear housing 107 is heated by the driving movement of the motion converting mechanism 113, the power transmitting mechanism 114 and the striking mechanism 115. As a result, air within the hermetic gear housing 107 expands and thus the internal pressure of the gear housing 107 is raised. At this time, the raised pressure acts upon the piston 185 of the pressure regulating chamber 181 and moves the piston 185 toward the motor housing side region 181*b* against the compression coil spring 187. Therefore, the capacity of the gear housing side region 181*a* of the pressure regulating chamber 181 increases and thus the capacity of the inner space 107*a* of the gear housing 107, including the capacity of the gear housing side region 181*a*, increases. As a result, the increase of the internal pressure of the gear housing 107 can be prevented. Thus, a striking failure which may be caused by increase of the internal pressure of the gear housing 107 can be prevented, and leakage of the lubricant can also be prevented.

When the inner space 107*a* of the gear housing 107 is cooled and its internal pressure drops, the piston 185 is acted upon by a suction force which is caused by a negative pressure formed in the inner space 107*a* of the gear housing 107. As a result, the piston 185 is returned to its initial position in a direction that reduces the capacity of the gear housing side region 181*a*. At this time, the biasing force of the compression coil spring 177 acts upon the piston 185 in such a manner as to assist the return movement of the piston 185.

Besides the above-described embodiments, the invention can also be applied to a hammer drill of the type which utilizes a crank mechanism as the motion converting mechanism 113. Further, the present invention is not limited to the hammer drill 101 but may be applied to any power tool in which a housing for a driving mechanism is filled with lubricant for lubricating the driving mechanism.

DESCRIPTION OF NUMERALS

101 hammer drill (power tool)
103 body
105 motor housing
105*a* inner space (outside)
105*b* vent
106 inner housing
107 gear housing
107*a* inner space (accommodating space)
108 sealing member
109 grip
111 driving motor
112 armature shaft
113 motion converting mechanism (driving mechanism)
114 power transmitting mechanism (driving mechanism)
115 striking mechanism (driving mechanism)
117 trigger
119 drill bit (tool bit)
121 driving gear
123 driven gear
124 engaging member
125 rotating shaft (outside member)
126 ball bearing
127 rotating element
128 swinging rod
129 swinging ring
131 first transmission gear
133 second transmission gear
135 sleeve
137 tool holder
141 cylinder
143 striker
145 impact bolt
147 cooling fan
151 pressure regulating passage (passage)
153 stop hole
153*a* inlet
154 clearance
155 cylindrical member (inside member)
157 through hole
157*a* outlet
159 spiral groove
161 bearing
163 bearing
165 stopper ring
165*a* axial end surface
167 spiral groove

We claim:

1. A power tool comprising:

a power tool body, a tool bit coupled to the power tool body, the tool bit performing a predetermined operation to a workpiece, a driving mechanism that drives the tool bit, an accommodating space disposed in the power tool body, wherein the accommodating space is hermetically sealed and houses the driving mechanism, a lubricant filled within the accommodating space to lubricate the driving mechanism, a passage via which an inside and an outside of the accommodating space communicate with each other, wherein, the passage has an accommodating space side opening that is open to the inside of the accommodating space and an outside opening that is open to the outside of the accommodating space, the passage being configured to extend, starting from the accommodating space side opening, in a direction away from the outside opening, then turns around and extend toward the outside opening and, a lubricant leakage preventing region provided within the passage, the region preventing the lubricant from leaking from the inside to the outside of the accommodating space.

2. The power tool as defined in claim 1 further comprising:

an outside member, an inside member fitted into the outside member, wherein the passage comprises an axially extending clearance between fitting surfaces of the outside member and a through hole that axially extends through the inside member and wherein the clearance and the through hole communicate with each other at one respective axial end, while the other axial end of the clearance is open to the inside of the accommodating space and the other axial end of the through hole is open to the outside of the accommodating space.

3. The power tool as defined in claim 2, wherein the driving mechanism comprises a shaft member that is drivingly rotated, the shaft member having an end region with a recess disposed at the end region, wherein the outside member is defined by the end region of the shaft member, the inside member being fitted into the recess of the outside member, while the lubricant leakage preventing region is defined by a spiral groove formed on the inner surface of the recess of the outside member, wherein the spiral groove is configured to push back the lubricant within the groove to the inside of the accommodating space by rotating together with the outside member.

4. The power tool as defined in claim 1 further comprising:

an outer tubular member, an outer opening provided with the outer tubular member, an outer hole extending in a longitudinal direction within the outer tubular member, the outer hole having an end portion at the outer opening, an inner tubular member inserted into the outer tubular member via the outer opening, inner openings respectively disposed at both ends of the inner tubular member, an inner hole penetrating the inner tubular member to communicate both the inner openings, wherein the accommodating space side opening is defined by the outer opening, while the outside opening is defined by one of the inner openings.

5. The power tool as defined in claim 4, wherein the driving mechanism comprises a shaft member having an end region with a recess disposed at the end region and the outer tubular member is defined by the end region of the shaft member, the inner tubular member being fitted into the recess of the outer tubular member, while the inner wall of the recess of the outer tubular member comprises a spiral groove that pushes back the lubricant within the groove to the inside of the accommodating space by rotating together with the outside member.

6. The power tool as defined in claim 1, wherein the tool bit is defined by a hammer bit.

* * * * *